United States Patent [19]

Murata

[11] Patent Number: 4,871,269

[45] Date of Patent: Oct. 3, 1989

[54] PORTABLE LABEL PRINTING APPLICATOR APPARATUS

[75] Inventor: Shinsuke Murata, Iwate, Japan

[73] Assignee: Kabushiki Kaisha Sato, Japan

[21] Appl. No.: 185,958

[22] Filed: Apr. 25, 1988

[30] Foreign Application Priority Data

Apr. 28, 1987 [JP] Japan ..... 62-103284

[51] Int. Cl.[4] ..... B41J 3/20

[52] U.S. Cl. ..... 400/88; 101/288

[58] Field of Search ..... 455/603; 101/288, 291, 101/292; 400/88, 472, 474, 477, 479

[56] References Cited

U.S. PATENT DOCUMENTS

| | | | |
|---|---|---|---|
| 4,264,396 | 4/1981 | Stewart | 101/67 |
| 4,444,520 | 4/1984 | Hanakata et al. | 400/88 |
| 4,628,541 | 12/1986 | Beavers | 455/603 |
| 4,677,428 | 6/1987 | Bartholow | 455/603 |
| 4,706,096 | 11/1987 | Sato | 101/288 |
| 4,746,932 | 5/1988 | Sato | 101/288 |

FOREIGN PATENT DOCUMENTS

| | | | |
|---|---|---|---|
| 35004 | 9/1981 | European Pat. Off. | 400/88 |
| 2015220 | 9/1979 | United Kingdom | 400/88 |

OTHER PUBLICATIONS

Morrissey, "Typewriter . . . Keyboard", IBM Technical Disclosure Bulletin, vol. 20, No. 10, pp. 4250–4251, 3/78.

*Primary Examiner*—William Pieprz

*Attorney, Agent, or Firm*—Ostrolenk, Faber, Gerb & Soffen

[57] ABSTRACT

A system for inputting label related information and for printing and applying labels to articles or the like is constituted of a self-contained label printer unit, a separate self-contained data inputting unit and a self-contained power supply unit which houses the relatively heavy power supply and other circuits which do not require to be contained in either the data input unit or in the label printer. The power supply unit requires no holding by hand and is thus suitable for being stored in the operator's pocket or attached or strapped to the operator's waist. Initially, only the data unit needs to be handled by hand for entering label related information. Thereafter, the label printer unit is manipulated by hand to cause labels to be printed and to be applied to articles. The data input unit may be connected to the power supply directly as by cable or the like or, to obtain greater mobility and ease of use, wirelessly by means involving transfer of information by light or sonic waves.

10 Claims, 4 Drawing Sheets

PORTABLE LABEL PRINTING APPLICATOR APPARATUS

BACKGROUND OF THE INVENTION

This invention relates to a portable label printing system and, more particularly, to a portable label printing system having a particularly light and therefore easier to handle data inputting unit.

Conventional, electronically-controlled, portable label printing systems have been in use for entering into the system merchandise related information that is thereafter imprinted on labels suitable for being attached to merchandise or the like. One typical system of this type is constituted of two selfcontained units including a label printer/applicator unit and a data inputting unit. Label related information is entered into the data inputting unit and the labels are printed and applied by the label printer/applicator unit.

Invariably, a thermal print head is used in the label printer unit because thermal print heads are light, compact and easy to service and maintain. But thermal print heads also have disadvantages One is that they consume more power. Consequently, the typical power supply for a thermal print head is heavy. Thus, the incorporation of the power supply in the label printer/applicator unit of the system results in a printer/applicator unit which is heavier and more difficult to use.

The prior art's solution has been to locate the power supply externally of the label printer/applicator unit, in the self-contained data input unit of the system.

The typical prior art label printing system is illustrated in FIG. 3 and is seen to include an, electronically-controlled, portable label printer/applicator unit 2 and a data input unit 3, the two units being connected to one another by cable 4. For brevity, the label printer/applicator unit 2 will be referred to from here on as "the printer unit", even though the unit 2 is also used for applying printed labels to merchandise. Similarly, the data input unit 3 will be referred to more simply as the "input unit 3".

Information to be imprinted on labels is inputted by means of input unit 3 which unit is conveniently portable and sized to be held and operated with one hand and to be carried in one's pockets or the like. The typical input unit 3 includes an input unit interface 6, an input unit control circuit 7 having a RAM data memory and a ROM program memory, a rechargeable battery 8 for powering the entire system, an input unit keyboard 9, a power switch, operational keys 10 including transmission and function keys, auxiliary switches, and a liquid-crystal display 11 for displaying input data thereon.

Electrical power and label printing information are supplied from input unit 3 to printer unit 2 via cable 4, the cable 4 mating with connectors 5 and 31 of units 3 and 2, respectively.

Printer unit 2 includes a label printing section 13, a grip 2 and a label roll holding section 14. Printed labels are discharged from the label printing section 13 to be affixed to articles by means of label applicator roller 15. The interior of printer unit 3 may be accessed by uncovering the bottom cover 17 through actuation of the open/close button 16.

A roll of thermal labels R, which is usually mounted in label roll holder section 14, consists of a continuous thermal label strip T that is wound into a roll. As illustrated in FIG. 4, the thermal label strip T is constituted of a backing sheet S that is coated with a separating agent and which has a plurality of adherable labels L which are detachably connected to the backing sheet S one behind the other. Information in the form of a bar code B, alphanumeric data or the like which specifies, for example, a merchandise code, a manufacturer's code, a department code, a price or similar information I is imprinted on the labels L. The holes D on the backing sheet S, adjacent the labels L, permit detection of the exact position of the labels. Suitable marks as for example eye marks or the like may be printed on the reverse side of the backing sheet S for enabling positioning of the backing sheet S in the printer unit 2.

The label strip T is fed from thermal label roll R into a label strip passage 19 and past a position sensor 18 The strip T is guided via guide rollers 20 toward thermal print head 21 and a platen 22. At the print head 21, the labels L are imprinted with information which is inputted from the input unit 2. Immediately past the print head 21, the backing sheet S is bent sharply around bending pin 23, in a manner which causes the labels L to peel off backing sheet S. The leading end of the backing sheet S (from which the labels have been peeled off) is guided by guide roller 24 toward a pair of transport rollers 25 which pull backing sheet S and guide it out of label printing applicator unit 13. The peeling of the labels L from backing sheet S is assisted by an auxiliary pin 26 located forward of the bending pin 23. Auxiliary pin 26 assures prompt peeling even of labels L which adhere tenaciously to backing sheet S Motive power for moving the strip S through the printer is supplied by stepping motor 27 which drives one of the pair of transport rollers 25 through timing belt 28. The stepping motor 27 is driven stepwise and at a rate that conveys and sequentially positions the labels such as to permit them to be imprinted with the proper information.

Label printer unit 2 is electronically-controlled by control circuit 30 which contains RAM data memory and ROM program memory. Power and input information, as noted above, is received through cable 4 via connector 31, the input information being routed through interface unit 32. The control circuit 30 is coupled to: interface circuit 32; position sensor 18; thermal print head 21; stepping motor 27; and operating switch 33. Thus, the control circuit 30 exercises overall control over the functioning of the entire printer unit. Usually, an operator actuates operating switch 33 to start and continue a printing cycle.

Typically, data to be imprinted is inputted via the keyboard 9 of input unit 3, stored temporarily in the RAM data memory of that unit and thereafter transferred to the printer unit 2 via cable 4.

Subsequently, operating switch 33 of printer unit 2 is depressed. This causes thermal strip T to be moved forwardly by transport rollers 25 and information to be imprinted on labels L at thermal print head 21. Immediately beyond thermal print head 21, backing sheet S is redirected around bending pin 23, causing labels L to peel off backing sheet S and to emerge beneath application roller 15. The application roller 15 aids in applying the printed labels to items of merchandise or the like.

One key point to note is that the prior art lightens the printer unit 2 by locating the relatively heavy battery 8 in the input unit 3. While this facilitates use of the printer unit 2, the transfer of the battery to the input unit 3 creates other problems.

For example, the printer unit 2 is typically carried in one pocket and the input unit 3 in another. Initially, the input unit is retrieved and held in the left hand while data is entered with the right hand by means of keyboard 9. Next the input unit is replaced in its pocket and the printer unit 2 is withdrawn from the other pocket and the switch 33 is actuated. This causes labels L to be imprinted with information and to emerge at applicator roller 15. Printer unit 2 is then manipulated as needed to apply the labels L to articles. The process requires too many hand manipulations. The overall efficiency of the label printing and applying process is therefore less than satisfactory.

SUMMARY OF THE INVENTION

Accordingly, it is a primary object of the present invention to further reduce the weight and therefore the ease of using and manipulating the various units of a label printing system.

The foregoing and other objects of the invention are realized by separating the heaviest component of the label printing system, namely the power supply, from the other units. In the system according to the invention, there are three separate units namely a conventional label printing and applying unit ("printer unit" for short), a novel, comparatively much lighter, data input unit, and a separate power supply unit which contains the batteries and other circuits which do not have to be present in the data input unit or in the printer unit This permits the power supply unit to be permanently kept in its pocket which is strapped to or otherwise supported on the user's body. Consequently, since only the input unit and the printer unit require occasional holding in the user's hand, the task of holding and manipulating the units is facilitated considerably by the relocation of the heaviest component to the novel power supply unit which never needs to be held by hand. This facilitates the task of printing and applying the labels considerably.

In one arrangement, label printing information is entered by means of a keyboard located on the input unit. This data is then transferred automatically to the power supply unit which transferred the data further to the printer unit.

Information is transferred from the data input unit to the power supply unit by a cable connecting the units or wirelessly as for example by transmission through optical or sonic waves.

Other features and advantages of the present invention will become apparent from the following description of the invention which refers to the accompanying drawings.

DETAILED DESCRIPTION OF THE PREFERRED EMBODIMENTS

Figure 1:
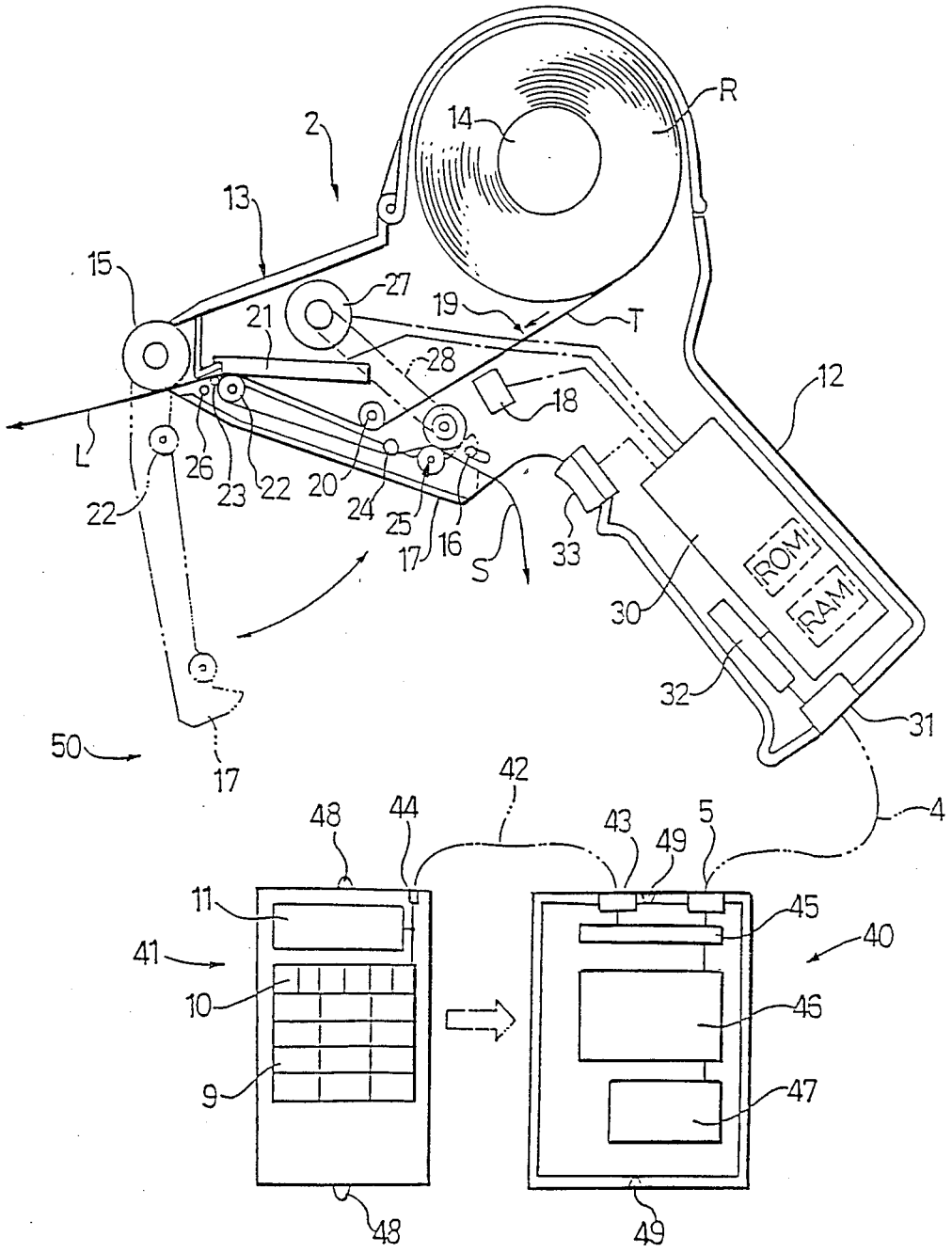
FIG. 1 is a diagrammatic view of the different components of a label printing and applying system according to the present invention.
Figure 3:
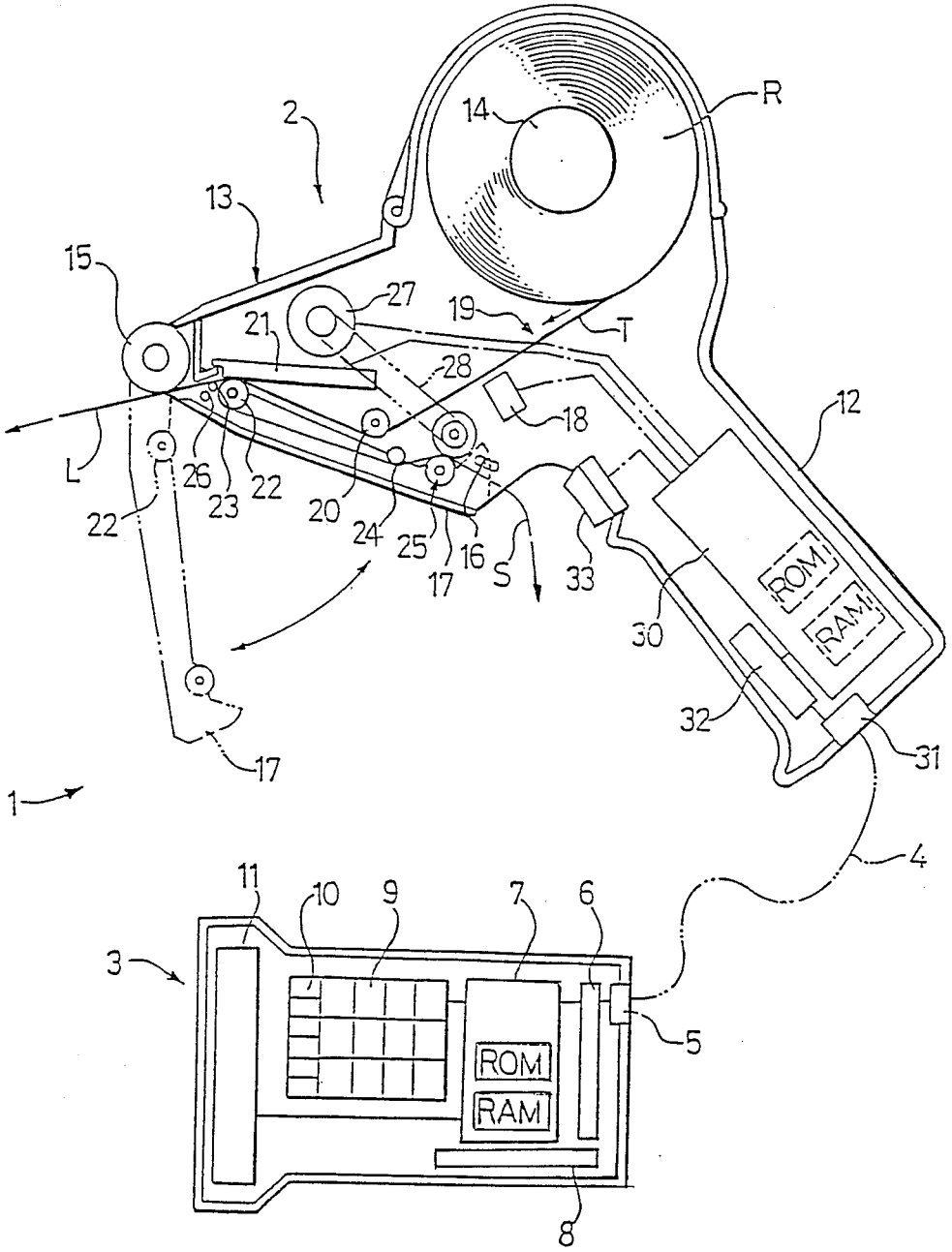
FIG. 3 shows a conventional label printing system consisting only of two units including a label printing and applicator unit and a data input unit.
Figure 4:
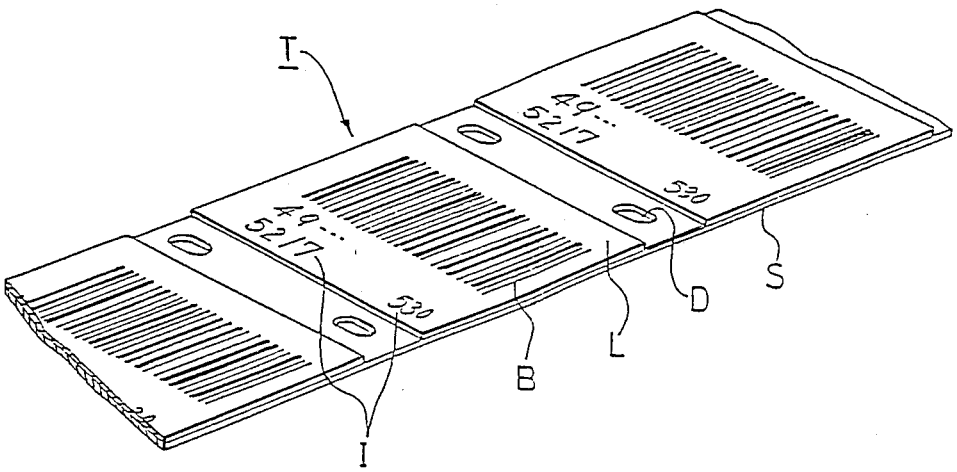
FIG. 4 is a perspective of a conventional thermal label strip.

Referring to FIG. 1, the label printer/applicator unit 2 (printer unit) has been previously described in relation to prior art FIG. 3. Since identical reference numerals are used in both FIG. 1 and 3 in conjunction with the printer unit 2 further description of the printer unit 2 is unnecessary.

FIG. 1 differs from FIG. 3 in that the data input unit 3 of FIG. 3 has been subdivided into two separate units including a power supply unit 40 and a data input keyboard unit 41, the units 40 and 41 being interconnected by cable 42 with the aid of respective connectors 43 and 44.

The power supply unit 40 includes a power supply interface 45, a control circuit 46 and a rechargeable battery 47. The lightened data input keyboard unit 41 includes the keyboard 9, operating keys 10 and a liquid-crystal display 11, all of which are interfaced to and controlled by the control circuit 46 of power supply unit 40.

Data input keyboard unit 41 may be mechanically secured in a detachable manner to power supply unit 40 by mechanical means (not shown) for example by Velcro tape or by means of engaging tongues 48 and corresponding engaging recesses 49 on power supply unit 40. The data input keyboard unit 41 is therefore suitable for being carried in an operator's pocket together with power supply unit 40 and may be easily detached from the power supply unit 40 for carrying out the data entry function Accordingly, the present invention provides a portable label printing and applying system 50 which is comprised of three units including label printer unit 2, power supply unit 40 and data input keyboard unit 41. The system is designed such that the power supply unit 40 and the data input keyboard unit 41 are stored in one special pocket with the two units being attached to one another. The printer unit 2 is held in another pocket. To input data, data iput keyboard unit 41 is detached by the user from the power supply unit 40 so that the user may hold the input keyboard unit 41 by hand and enter the desired information through keyboard 9 and operating keys 10. The data may be verified as it is entered by observing the information appearing on liquid-crystal display 11. On completion of the data entry process, data input keyboard unit 41 is reattached to power supply unit 40. Note that since the data input keyboard unit 41 does not include the relatively heavy battery 47, the problem of operator fatigue arising from handling the data input unit of the prior art is avoided.

Figure 2:
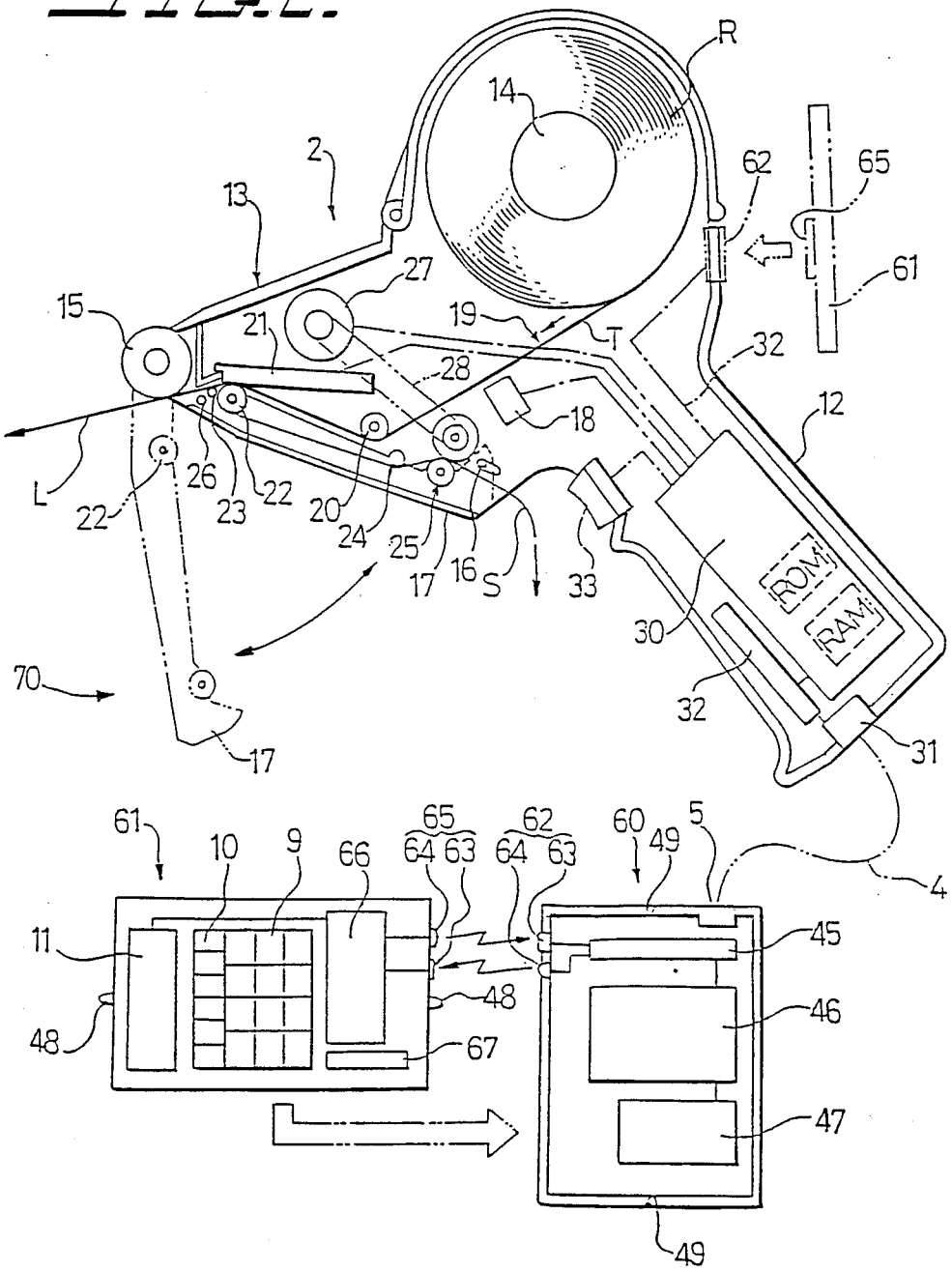
FIG. 2 is generally similar to FIG. 1 except that it depicts the transfer of information through wireless means.

While in the above embodiment power supply unit 40 and data input keyboard unit 41 are interconnected by cable 42 the invention is not limited to this arrangement and may be modified such that information is transferred between these units via electromagnetic or sonic waves, for example, through light or sonic waves. Such an embodiment is illustrated in FIG. 2. Here, a modified power supply unit 60 and a modified data input keyboard unit 61 are provided with energy converting transducers such as LEDs and the like for communicating wirelessly with one another. (The above units have many elements which are similar to the elements found in the embodiment of FIG. 1 and the description thereof will not be reiterated.)

The modified power supply unit 60 is coupled to printer unit 2 by cable 4 while the modified data input keyboard unit 61 is mechanically attachable, in a detachable manner, to the power supply unit 60 as for example with Velcro tape or disengageable engaging tongues 48 and engaging recesses 49.

The interface 45 of the power supply unit 60 includes a data reception section 62 for data transfer by optical, i.e. light waves, means. Data reception section 62 comprises an energy conversion device that is constituted of light-receiving diode 63 and LEDs 64. The data reception section 62 of the power supply unit 60 communicates with a corresponding data transfer section 65 which is disposed in data input keyboard unit 61. As in the data reception section 62 of the power supply unit 60, the data transfer section 65 of the data input keyboard unit 61 is comprised of light-receiving diode 63 and LEDs 64. The system is configured such that data in the form of light beams which originate in the data input keyboard unit 61 may be directed at the data reception section 62 of the power supply unit 60 and, in this manner, data transfer control signals and printing data signals may be sent and received by the units 60 and 61.

Together, the LEDs 64 and the light-receiving diode 63 of the power supply unit 60 and data input keyboard unit 61 comprise energy conversion devices that form a photocoupler through which information is transferred back and forth. Transfer control signals and printing data signals are thus converted into light energy, for example, a beam of infrared light, and the light energy is then converted to electrical signals which signals may then be supplied to the control circuit 30 of printer unit 2, as needed for the operation thereof.

Data input keyboard unit 61 further includes a data input keyboard unit control circuit 66 for controlling the operation of data inputting, display and transfer within keyboard unit 61 and a battery 67.

The label preparing system 70 depicted in FIG. 2 requires manipulation of only the data input keyboard unit 61 which unit may be placed flat on the palm of the user's hand. Note that the power supply unit 60 may remain at all times in the operator's pocket or attached to the waist as a result of the wireless mode of transmitting information between the power supply unit 60 and the data input keyboard unit 61. Accordingly, the cable 42 of the embodiment of FIG. 1 is omitted in the embodiment of FIG. 2. This imposes less restrictions on the ability to move and manipulate the data input keyboard unit 61 which further enhances the overall operability of the wireless embodiment of the present invention.

The dotted-line box 61 and the adjacent dotted arrow (at the upper right hand corner of FIG. 2) indicate that the data input keyboard unit 61 may be detachably attached by suitable mechanical means to the side of the printer unit 2, instead of or in addition to the power supply unit 60.

Means other than optical means may be used to transfer data in a wireless manner between the power supply unit 60 and the data input keyboard unit 61. For example, the wireless data transfer means may utilize sonic energy and to this end each of the units 60 and 61 may be provided with an audio coupler arrangement that utilize a set of sonic transmitter and receiver elements. Generally, the wireless transmitting means is as in the arrangement of FIG. 2 but the optocoupler is replace by an audio coupler.

Thus, the primary objective of the present invention is met in that a data input keyboard unit is provided which is separate from the printer unit and which is not burdened by a heavy power supply. The label printing systems of the present invention deliver good overall reliability and operability and their mobility is enhanced considerably as a result of the simplified data input keyboard which is considerably smaller and lighter. Thus, the data inputting operation is facilitated and the overall productivity and efficiency of the system is improved.

Although the present invention has been described in relation to particular embodiments thereof, many other variations and modifications and other uses will become apparent to those skilled in the art. It is preferred, therefore, that the present invention be limited not by the specific disclosure herein, but only by the appended claims

What is claimed is:

1. A portable label printing system, comprising:

a self-contained, hand held, main label printer unit, the label printer unit including: means for supporting a roll of labels, printing means for imprinting information on labels, a passageway extending between the label supporting means and the printing means, conveying means for conveying the labels from the label supporting means to the printing means, the printer unit being of a size which permits the holding thereof in one hand while applying inprinted labels to articles, the printer unit further including a first memory for storing therein printing data, a second memory for storing therein a program, and control means for controlling the overall operation of the label printer unit, the label printer unit being suitable for imprinting information on labels which are adhered to a backing sheet and further including peeling means for peeling the labels from the backing sheet and further including label applicator means in the printer unit for applying peeled labels to articles;

a self-contained, hand held, data input keyboard unit including a keyboard for entering therewith data which specifices the information to be imprinted on the labels; and first cable;

a self-contained, hand holdable, power supply unit suited for being carried by the body of an operator of the label printer unit and directly connected to the printer unit by means of the first cable and effective for supplying electrical power thereto, the printer unit being hand holdable and wieldable independently of the data input keyboard unit and the power supply unit during application of labels to articles and the data input keyboard unit being wieldable independently of the printer unit and the power supply unit during data input operations; and coupling means for enabling the data input keyboard to communicate with the power supply unit.

2. The portable label printing system according to claim 1, the coupling means including a second cable for connecting the data input keyboard unit to the power supply unit.

3. The portable label printing system according to claim 2, wherein the first cable is effective for supplying label related information to the label printer unit.

4. The portable label printing system according to claim 1, further comprising securing means for detachably attaching the data input keyboard unit to the power supply unit.

5. The portable label printing system according to claim 1 wherein the coupling means comprises a wireless transmitting and receiving means for transferring data from the data input keyboard unit to the power supply unit.

6. The portable label printing system according to claim 5, further comprising securing means for detachably attaching the data input keyboard unit to the power supply unit.

7. The portable label printing system according to claim 1, further comprising securing means for detachably attaching the data input keyboard unit to the label printer unit.

8. The portable label printing system according to claim 5, wherein the wireless transmitting and receiving means includes means for transmitting and receiving data by means of light waves.

9. The portable label printing system according to claim 5, wherein the wireless transmitting and receiving means includes means for transmitting and receiving data by means of sound waves.

10. The portable label printing system according to claim 1, further including data display means for displaying data entered into the data input keyboard unit.

* * * * *